United States Patent [19]

Ketchman

[11] 4,257,588

[45] Mar. 24, 1981

[54] EXERCISE BICYCLES

[75] Inventor: Jeffrey Ketchman, Westport, Conn.

[73] Assignee: AMF Incorporated, White Plains, N.Y.

[21] Appl. No.: 52,996

[22] Filed: Jun. 28, 1979

[51] Int. Cl.[3] ..... A63F 23/02

[52] U.S. Cl. ..... 272/73; 272/132

[58] Field of Search ..... 272/73, 132

[56] References Cited

U.S. PATENT DOCUMENTS

| | | | |
|---|---|---|---|
| 3,259,385 | 7/1966 | Boren | 272/73 |
| 3,601,395 | 8/1971 | Morgan | 272/73 |
| 3,649,008 | 3/1972 | Zinken et al. | 272/132 X |
| 3,848,870 | 11/1974 | Craig | 272/73 X |

*Primary Examiner*—Richard C. Pinkham
*Assistant Examiner*—Arnold W. Kramer
*Attorney, Agent, or Firm*—George W. Price; Walter Lewis

[57] ABSTRACT

A dual-crank type upper body and arm exerciser attachment readily attachable to existing exerciser bicycles, and in which the drag brake for the arm exerciser comprises an incompressible sleeve of rubber or elastomeric material pressed against the crank arm shaft.

1 Claim, 7 Drawing Figures

EXERCISE BICYCLES

This invention relates to an upper body and arm exerciser, and more particularly, to a dual-crank type upper body and arm exerciser attachment for exerciser bicycles.

It is an object of this invention to provide a low cost dual-crank type upper body and arm exerciser attachment which can be readily attached to existing exerciser bicycles and in which the drag on the arm exerciser can be readily and continuously adjusted.

Briefly, in my invention, the attachment readily attaches to the front fork head tube or the like of existing exerciser bicycles, and the drag on the attachment comprises a rubber or elastomeric sleeve for imposing a continuously variable drag on the crank shaft of the arm exerciser.

In the drawings, FIG. 1 is an elevation view of a bicycle type exerciser incorporating my invention;

Figure 6:
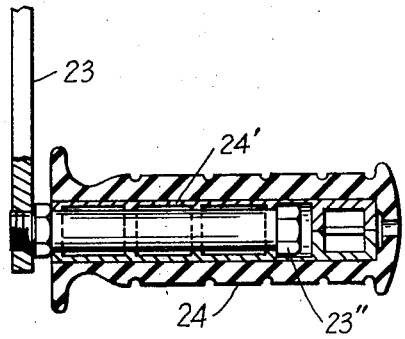
Figure 4:
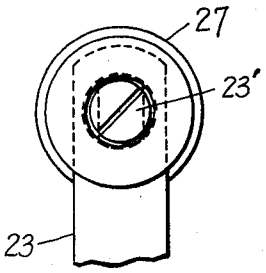
FIG. 4 is an end view from along the end view line 4—4 of FIG. 3.
Figure 5:
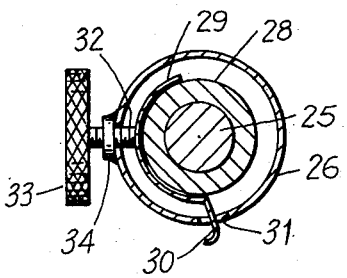
FIG. 5 is a cross-sectional view taken along the section line 5—5 of FIG. 3.

and FIG. 6 is a sectional view through one of the arm exerciser grip handles.

Figure 1:
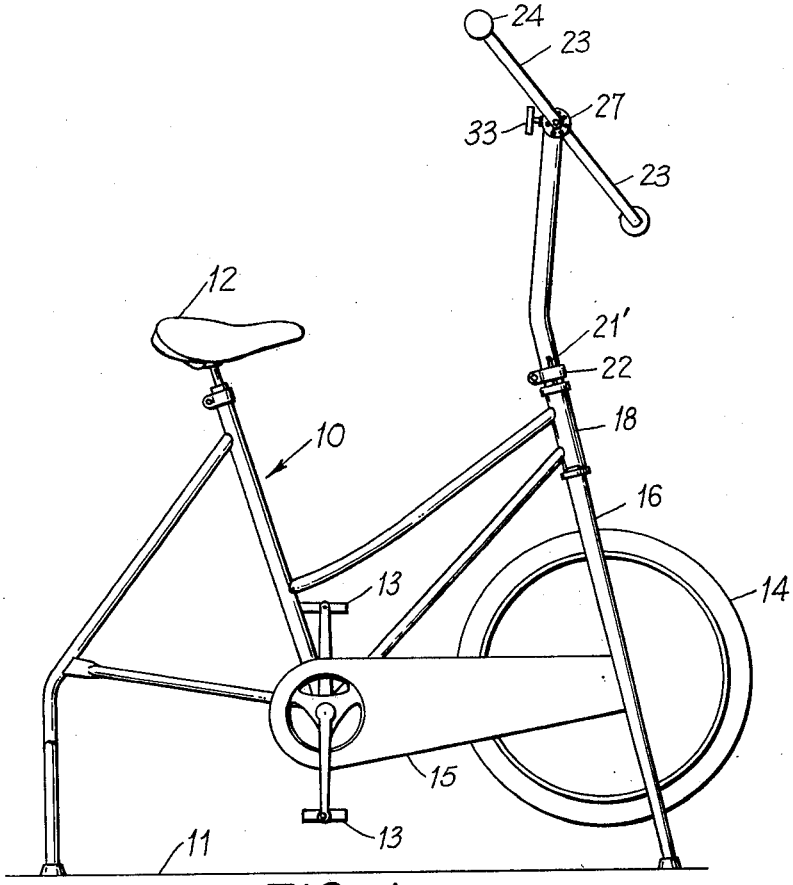

Referring now first to FIG. 1, illustrated is a conventional stationary exerciser bicycle having a frame 10 which is adapted to rest on a floor 11. The frame is provided with a seat 12, and foot pedals 13. A person seated on the bicycle can pump the pedals with his or her feet, which in turn drive a front wheel 14 through conventional means not shown such as sprocket wheels and chain positioned behind a guard 15. As is conventional, means not shown are provided for imposing a drag on the wheel 14 to vary the amount of work the person must do to rotate the wheel.

Figure 2A:
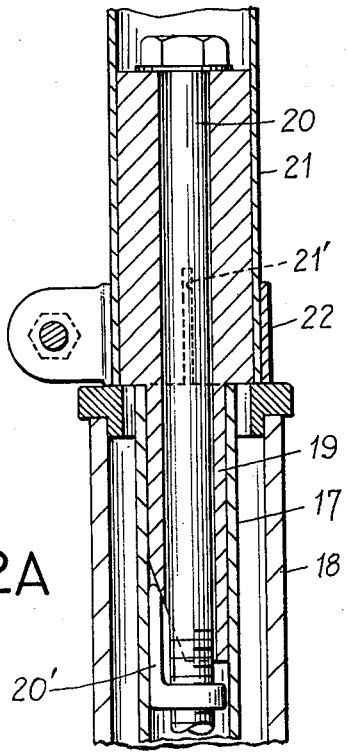
FIG. 2A is an enlarged broken away sectional view of the front fork head tube part of the exerciser bicycle.

The illustrated frame 10 has a conventional front fork 16 for the wheel 14, the stem 17, see FIG. 2A, of the front fork 16 being positioned in the front fork head tube 18 of the frame. Conventionally, a stem of a handlebar (not shown) enters the head tube 18 to be clamped to the stem 17 so the person seated on the exerciser has a handlebar to grip just as if he or she were riding a bicycle. The means for clamping the handlebar to the stem 17 would comprise means such as the expandable clamp means comprising the handlebar stem 19, its bolt 20, and a wedge-shaped extension nut 20' at the bottom of the bolt. All this is conventional and well understood by those skilled in the art.

In my invention the handlebars would be simply disconnected from the stem 19 and my arm and body exerciser attachment connected thereto instead. As shown, the exerciser comprises a tube 21 which has slots 21' at the bottom thereof. This slotted end of the tube 21 is merely slipped over the upper end of the stem 19 and then clamped thereto by tightening a split circular clamping band or strap 22 about the slotted lower end of tube 21.

Figure 2B:
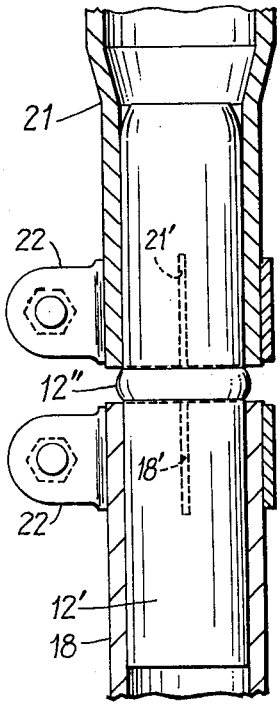
FIG. 2B is a view similar to FIG. 2A showing a modification.
Figure 3:
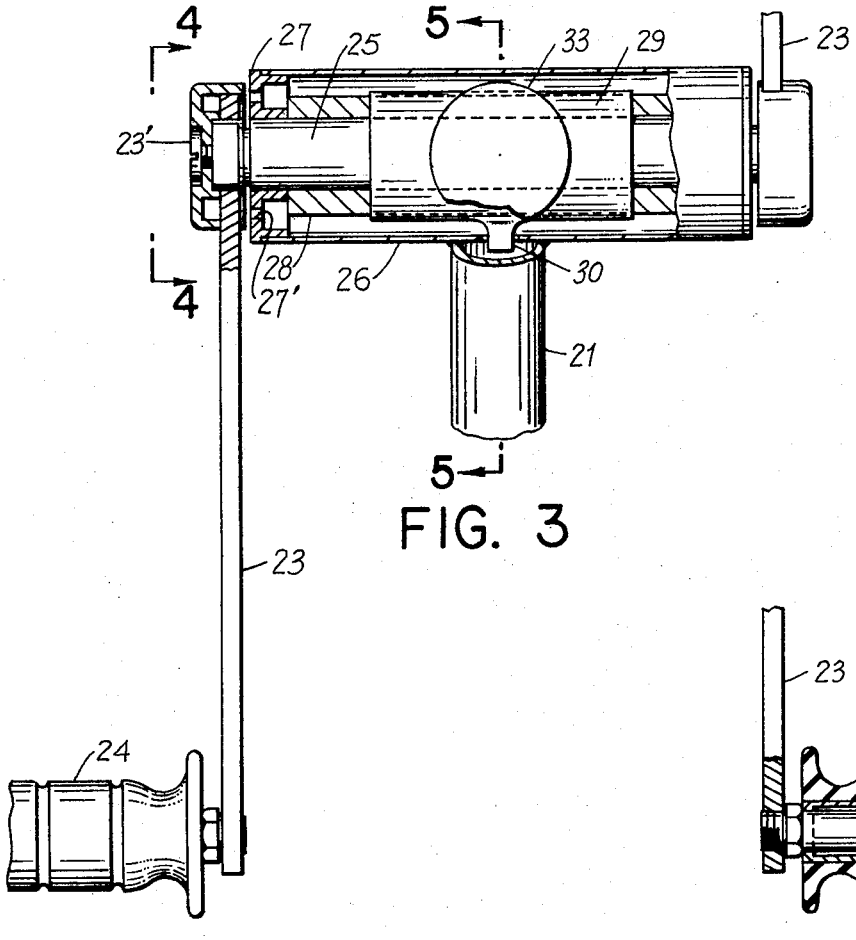
FIG. 3 is a broken away enlarged rear view of the arm exerciser proper.

In the modification shown in FIG. 2B, the tube 21 would be connected to the front fork head tube 18 by a pair of clamping bands 22 and a member 12' which is a conventional seat post. As before, the tube 21 would have end slots 21' but the head tube 18 would also have end slots 18'. At its center the post 12' would have a bulge 12'' to prevent the post 12' from falling down into the head tube 18. Since the ends of tubes 18 and 21 are slotted, when the clamps 22 are tightened, these two tubes are affixed to each other since they are then both clamped to the common post 12'.

The tube 21 is vertically disposed but with a slight forward tilt for proper positioning of the crank arms relative to the seat, and at its upper end has my crank type arm and body exerciser mounted thereon, see FIGS. 3–6. The arm and body exerciser comprises a pair of arms 23 having hand grips 24 rotatably connected to their outer ends. The inner ends of the arms 23 are interconnected by a shaft 25, which comprises the axis of rotation for the cranks comprising arms 23 and their hand grips 24. This shaft is rotatably mounted to the upper end of the tube 21 with the arms being disposed along opposite sides thereof and extending in directions perpendicular to the shaft. The arms 23 are illustrated as extending in opposite directions. However, they can be changed to extend in the same direction. This is because the outer ends of the shaft 25 are flat and are received in flat holes in the upper ends of arms 23. The position of the arms 23 can be changed 180 degrees by loosening studs 23' to change the direction of the arms 23. At the outer ends of arms 23, the grips 24 are connected thereto by bolts 23'' and lengthwise split bearing pieces 24'. In this manner parts 24', besides being bearing, they are sized so that grips 24 can be conventional bicycle handlebar grips.

The means for mounting the shaft 25 to the upper end of tube 21 comprises a cylinder or the like 26 welded or otherwise connected to the tube 21 in a T-shaped arrangement. The opposite ends of the cylinder 26 have end bearings 27 closing the same and incorporating holes 27' to promote cooling of the drag brake for the dual crank arm and upper body exerciser. The shaft 25 is free to rotate inside the cylinder 26 in the bearings 27.

Disposed about the shaft 25 between the bearings 27 is a mass 28 of elastomeric material such as rubber having a Poisson's ratio of about 0.5. This mass 28 is actually in the form of a thick sleeve, and it is pressed against the shaft 25 by a pressure plate 29 so as to impose a continuously variable drag on the shaft 25. The pressure plate 29 is an elongated semi-cylinder and has a hooked tab 30 at its lower edge which enters a notch 31 in the cylinder 26 to keep the plate 29 in proper position, and from rotating with the shaft 25 when it urges the mass 28 against the shaft 25. The means for urging the plate 29 against mass 28 comprises a stud 32 screwed into a suitable hole in the cylinder 26 or nut 34 affixed thereon. The inner end of stud 32 butts up against the plate 29, and its outer end has a wheel 33 for turning the stud 32 ever so slightly or much more depending upon the amount of drag one wants to impose on the arm exerciser.

The design of the drag brake is such that when applied the shaft 25 turns with respect to the sleeve 28, but when released the shaft 25 carries sleeve with it. This is because the sleeve 28 is relatively snug with respect to the shaft 25 but loose with respect to the plate 29 because of the greater radius of curvature for plate 29 than for shaft 25. So, when the drag brake is released, the sleeve 28 moves with shaft 25 so that when the drag brake is reapplied a new surface of sleeve 28 is presented to the plate 29 to thereby extend the wear life of the sleeve 28. Of course, it is possible to obtain many advantages of the invention without using the illustrated drag brake. For example, it is possible to omit the sleeve 28 and instead use a friction facing on the plate 29. However, the sleeve 28 is decidedly preferred since it gives long life, is very effective, and in addition, is very quiet or almost silent in operation.

It will now be seen that my invention provides a very low cost dual-crank type upper body and arm exerciser which is almost universally adaptable to all existing exerciser bicycles, and one in which the drag or load on the arm exerciser can be readily and continuously varied in a very low cost manner. For example, the cranks comprising parts 23, 24 in any event need a rotary axis, which is provided by the shaft 25, and the brake for the cranks 23, 24 comprise a very low cost and minimum parts one comprising essentially the elastomeric sleeve 28 and the brake application plate 29. When the plate 29 is urged against the sleeve 28 a friction drag is imposed on the shaft 25 since the sleeve 28 is clamped between the parts 25, 29. Of course, this drag brake is nicely incorporated into the means for rotatably mounting the shaft 25 to the upper end of the tube 21, which in any event is required, so that a quiet drag brake is obtained at very little additional cost or complication.

Additionally, in the invention, the spacing for arms 23 as measured by the length of cylinder 26 is selected to provide additional advantages, and the same for the length of the arms 23. That is to say, the grips 24 are spaced from each other by a distance equal to the average shoulder width. So, the exerciser can be used without fatiguing the wrists, but still, there is a forced rocking motion of the shoulders in addition to arm movement, similar to that provided by swimming with the crawl stroke; although a still different exercise is performed if the arms 23 extend in the same direction, similar to that of rowing. Further, the support 21 is sized and bent forward to so place the exerciser relative the seat 12 that the exerciser user's back is upright for comfort. This elevated position of the exerciser also makes it possible for the user to stand in front of the device and still do exercises. Thus, besides being comfortable to the wrists and back, the device makes it possible to exercise various parts of the upper body and do different kinds of exercise and either from a seated or standing position.

Other modifications will be obvious to those skilled in the art while still obtaining the advantages of the invention. For example, it is possible for the shaft 25, arms 23, and hand grips to be integral with each other. Also, it is possible to omit the end bearings 27 if the sleeve 28 fills the cylinder 26, although the illustrated arrangement with space between parts 26 and 28 and the bearing holes 27' is preferred since it promotes cooling of the drag brake to extend its life. Also, although the invention has been presented in terms of an attachment, it will be understood that it can instead be an integral part of an exerciser specifically designed in the first instance to utilize the novel structural and other features and advantages of my invention.

I claim:

1. In an exerciser bicycle comprising a frame having a front fork head tube, a dual-crank type upper body and arm exerciser attachment removably connected to said head tube, said attachment comprising a tube having its lower end removably connected to said head tube, a pair of crank arms connected at one of their ends to opposite ends of a common shaft, rotary hand grips connected to the other ends of said arms, said arms being positioned along opposite sides of said bicycle and extending from said shaft in directions perpendicular thereto, means at said crank arm one ends and opposite shaft ends for connecting said crank arms to said shaft to extend from said shaft in either opposite directions or the same direction with respect to each other, a cylindrical member being affixed in a T-shaped arrangement to the upper end of said attachment tube, said shaft being positioned in said cylindrical member, spaced end bearings in said cylindrical member for opposite ends of said shaft, and a brake positioned in said cylindrical member for imposing a drag on said shaft, said brake comprising an elastomeric material in said cylindrical member between said bearings, and means for forcibly urging said material into contact with said shaft, said material comprising a thick sleeve of resilient material having a Poisson's ratio of about 0.5, said sleeve being disposed snug on said shaft to turn therewith between said bearings, said last mentioned means comprising a semi-cylindrical pressure plate positioned between said sleeve and cylindrical member, and means for manually varying the amount of force on said plate urging said plate into contact with said sleeve and said sleeve into forcible contact with said shaft to vary said drag.

* * * * *